United States Patent [19]

Allen

[11] Patent Number: 4,926,809

[45] Date of Patent: May 22, 1990

[54] INTERNAL COMBUSTION ENGINE WITH ROTARY VALVE

[76] Inventor: Charles A. Allen, 55 Hidden Springs Rd., Spartanburg, S.C. 29302

[21] Appl. No.: 392,068

[22] Filed: Aug. 10, 1989

[51] Int. Cl.[5] ..... F01L 7/00

[52] U.S. Cl. ..... 123/190 A; 123/80 BA

[58] Field of Search ..... 123/190 A, 80 BA, 190 R

[56] References Cited

U.S. PATENT DOCUMENTS

| | | | |
|---|---|---|---|
| 3,628,518 | 12/1971 | Blair | 123/80 BA |
| 4,036,184 | 7/1977 | Guenther | 123/80 BA |
| 4,077,382 | 3/1978 | Gentile | 123/190 A |
| 4,333,427 | 6/1982 | Burillo | 123/190 A |
| 4,342,294 | 8/1982 | Hopkins | 123/190 B |
| 4,421,077 | 12/1983 | Ruggeri | 123/80 BA |

*Primary Examiner*—E. Rollins Cross

*Attorney, Agent, or Firm*—Daniel E. McConnell

[57] ABSTRACT

An internal combustion engine having a combustion cylinder, a piston moving within the cylinder, an intake manifold through which air flows into the cylinder, a fuel control for controlling the flow of fuel into the cylinder, and an inlet valve arrangement for controlling the flow of air into the cylinder, and in which there is an improvement in the inlet valve arrangement which comprises an elongate thin wall right circular cylindrical valve member mounted for rotation within the intake manifold about the longitudinal axis of the valve member and having an inlet flow opening therethrough extending lengthwise of said member for a predetermined length and arcuately thereabout over an arc of at least about 100 degrees and an air flow guide stationarily mounted within the valve member for directing air flow into the cylinder and for establishing the cross sectional area of a flow passageway for such air flow.

7 Claims, 3 Drawing Sheets

INTERNAL COMBUSTION ENGINE WITH ROTARY VALVE

FIELD AND BACKGROUND OF INVENTION

This invention relates to internal combustion engines having rotary valves. Example of prior patents disclosing such engines include U.S. Pat. Nos. 3,628,528 to Blair; 4,036,184 to Guenther; 4,077,382 to Gentile; 4,333,427 to Burillo; 4,342,294 to Hopkins; and 4,381,737 to Turner.

Persons working in the design and development of internal combustion engines of the reciprocating type have long recognized that the design of valve arrangements for admitting fluids to and exhausting fluids from cylinders have presented restraints on the achievement of certain desired operations. In seeking to overcome such restraints, proposals (such as those of the patent disclosures listed above) have been made to adopt a rotary valve arrangement, with the hoped for result of improving fluid flow or control. Such results have not been achieved, largely due to the configurations of valve members selected.

In particular, and as will be apparent to the careful student of the above mentioned disclosures, the flow paths involved in prior arrangements become elongated by the choice of rotary members, and thus control over fluid flows at relatively high engine operating speeds becomes difficult. Further, while the technology of controlling valve timing has been highly developed with regard to conventional reciprocating valves, there has not been an acceptable solution to controlling timing of rotary valves of the types disclosed.

BRIEF DESCRIPTION OF INVENTION

With the foregoing particularly in mind, it is an object of this invention to provide a rotary valve for an internal combustion engine which overcomes the difficulties of prior rotary valve arrangements. In realizing this object of the present invention, new prospects of controlling valve timing are opened and new and higher ranges of engine operating speeds are made achievable.

Yet a further object of this invention is to accomplish controllable and variable dwell of opening of a rotary valve of the generally type described. In realizing this object of the present invention, a novel arrangement of a thin wall right circular cylindrical valve member is employed which has an arcuate flow opening therethrough which extends over an arc of at least about 100 degrees measured on the circumference of the circle described by a plane perpendicular to the longitudinal axis of the member.

BRIEF DESCRIPTION OF DRAWINGS

Some of the objects of the invention having been stated, other objects will appear as the description proceeds, when taken in connection with the accompanying drawings, in which.

DETAILED DESCRIPTION OF THE INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
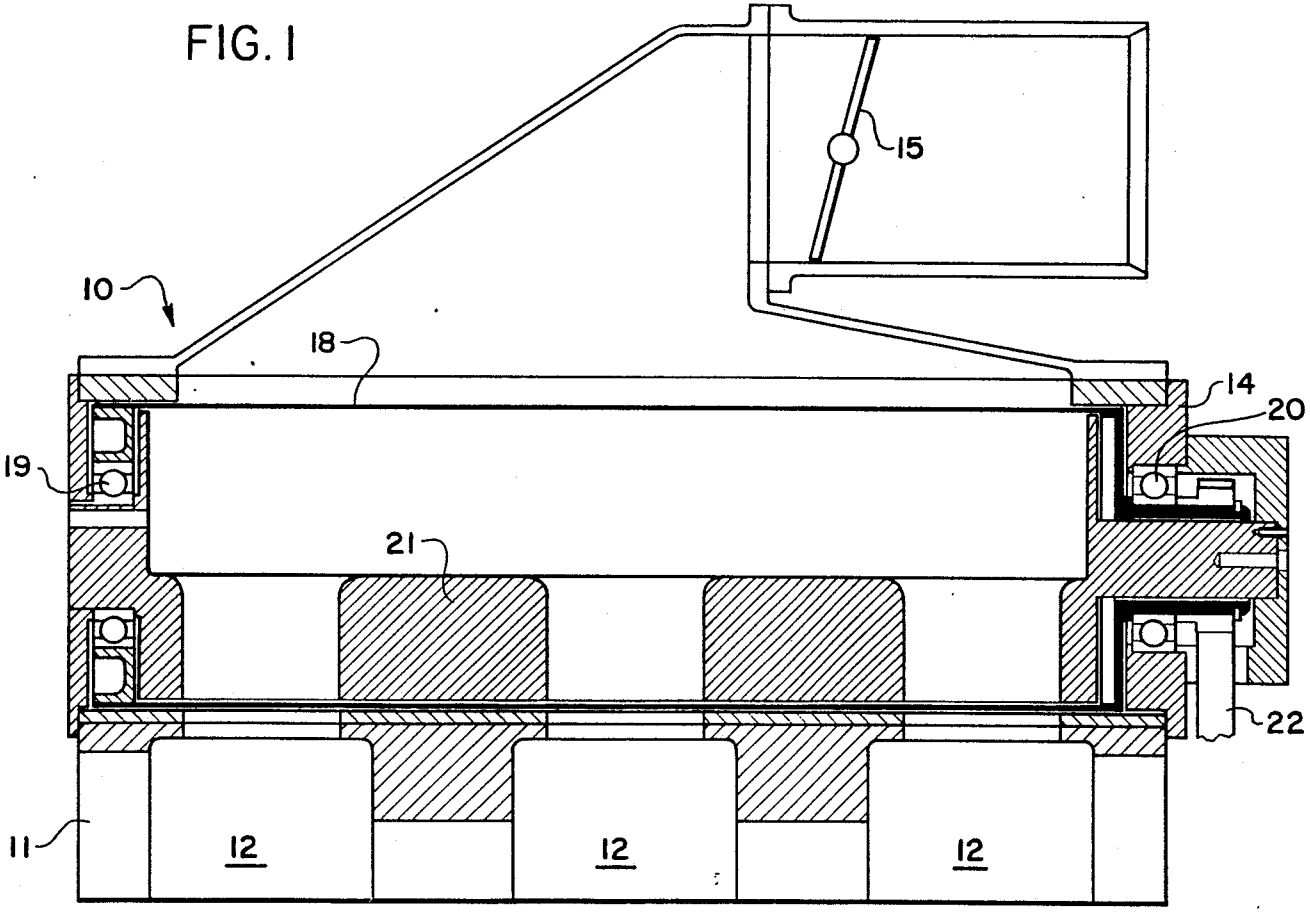
FIG. 1 is an elevation view, in section, through a portion of an internal combustion engine incorporating the valve arrangement of this invention.

Referring now more particularly to the accompanying drawings, an internal combustion engine is there shown and generally identified at 10. The engine has a crankcase 11 within which are defined a plurality of cylinders 12 (in the illustrated instance, three in number). As is conventional, pistons (not shown) reciprocate in the cylinders and combustion of an air and fuel mixture occurs to drive the engine. The volume rate of flow of air and fuel, and the mixing thereof, preferably is controlled by suitable means which may be selected from among those known to persons skilled in the applicable arts, with attention being given to the advantages of the present invention as described more fully hereinafter. In the illustrated form, air enters the engine through an inlet manifold 14, the volume of air flow is controlled by a throttle plate 15 (FIG. 1) and fuel is metered by an appropriate control and injected through nozzles (not shown) seated in nozzle seats 16 (FIG. 2) within the valve structure to be described hereinafter.

In accordance with the present invention and in order to achieve certain advantages as pointed out herein, inlet valve means are provided for controlling the flow of air into the cylinder. The inlet valve means takes the particular form of an elongate thin wall right circular cylindrical valve member 18 mounted for rotation within the intake manifold 14 about its longitudinal axis and having an arcuate inlet flow opening (seen most clearly from the sectional views of FIGS. 2 and 3) therethrough extending over an arc of at least about 100 degrees measured on the circumference of a circle described by the intersection of the valve member with a plane perpendicular to its longitudinal axis. The cylinder 18 is mounted for rotation by a pair of bearing means 19, 20 adjacent the ends thereof, each bearing means preferably being (as illustrated) an anti-friction or ball bearing having one race engaging the valve member and the other engaging a stationary support such as a portion of the inlet manifold housing or a fluid flow guide means 21 which is mounted within the the cylinder 18 as described more fully hereinafter. As so mounted, the valve member has certain relationships to the cylinders of the engine 10. In particular, the longitudinal axis of the thin wall cylinder, about which it rotates, is perpendicular to the central axis of associated cylinders in which combustion takes place. Preferably, for efficiency in fluid flows, the rotational axis of the thin wall cylinder is coplanar with the central axis of the combustion cylinder to which air and fuel is supplied. In a manner similar to the valve trains of prior internal combustion engines, means are provided for driving said valve member in rotation in timed relation to movement of pistons within the combustion cylinders. Preferably, such drive means may take the form of a belt 22 operatively connecting the engine crankshaft and the valve member.

Figure 2:
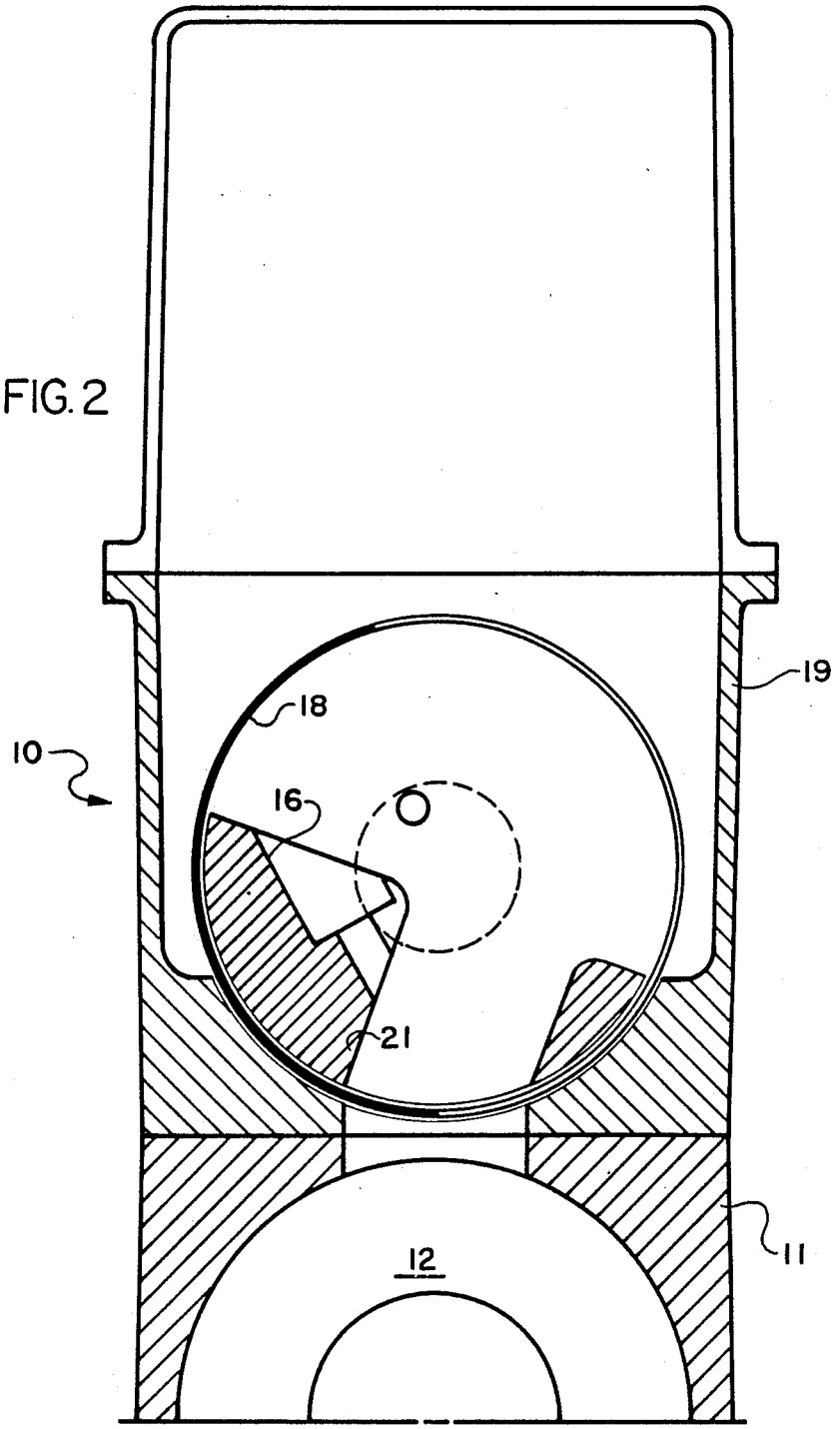
FIG. 2 is an elevation view, in section, through the engine of FIG. 1 and taken at right angles to the view of FIG. 1.

The use of a thin wall cylinder as the valve member accomplishes a number of desirable results. First, the thin wall enables the use of an arcuate opening having a greater extent than has been possible heretofore and which offers a greater range of possible variation which more nearly approaches the technology which has been highly developed in connection with more conventional valve trains as used in more conventional engines. As persons familiar with the design, operation and maintenance of internal combustion engines will be quick to realize, opening and closing times in relation to rotational positions of a crankshaft and dwell times that a valve is open have been the subject matter of significant attention in engine development and are known to have significant effect on engine efficiencies and operating speeds. The present invention provides a flexibility of control not previously available with rotary valve arrangements, and particularly for multiple cylinder engines. By way of illustration only, the arcuate extent of the opening indicated in FIG. 2 is in fact in excess of one hundred eighty degrees, and it is contemplated for the present invention that the arcuate openings used will usually be in excess of one hundred twenty degrees. Prior arrangements have not been able to accomplish such flexibility. That flexibility is further enhanced by the particular cooperation between the valve arrangement and the fuel supply arrangements contemplated by this invention, as described herein.

In particular, the presence within the envelope described by the rotating thin wall cylinder of the guide means 21 accomplishes a channeling of intake flow into the associated cylinder, permits "tuning" of the aerodynamic flow characteristics of the passageway to achieve desirable effects of charging in a manner similar to that well known with more conventional carburetors, and provides an opportunity to mount a fuel injection nozzle immediately at the valved passageway as shown by the provision of the nozzle seat 16. The guide means 21 establishes the cross sectional area of a flow passageway for such air flow and occludes no more than a minor portion of the flow passage area through the thin wall cylindrical valve member for permitting air flow into the combustion cylinder to be governed principally by the dwell interval established by the arcuate extent of the inlet flow opening.

Figure 3:
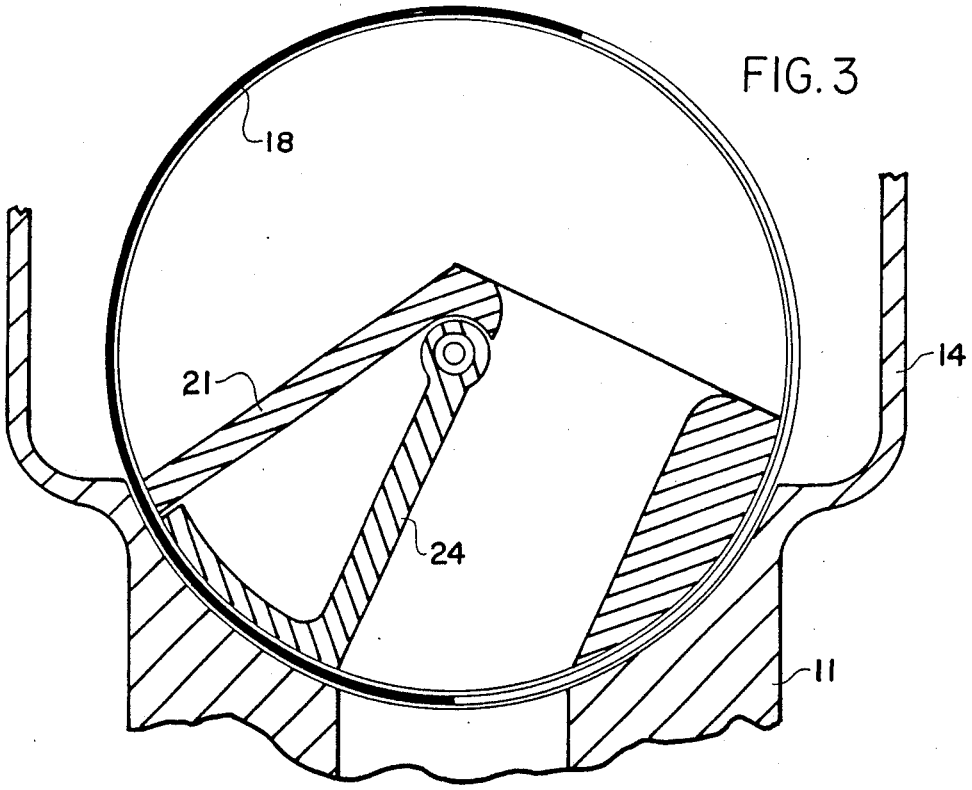
FIG. 3 is an enlarged view similar to FIG. 2, showing a modified form of the arrangement of this invention.
Figure 4:
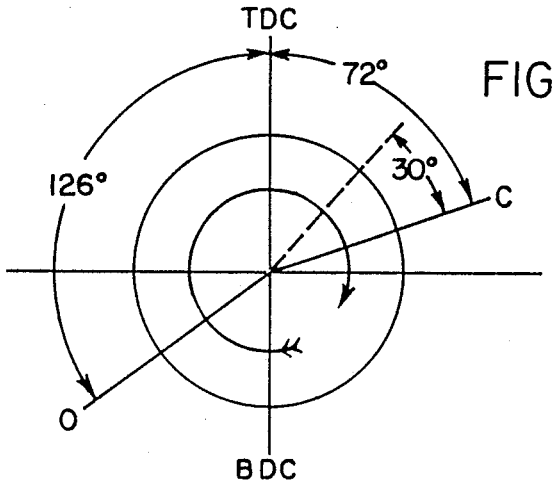
FIG. 4 is a schematic diagram illustrating valve timing accomplished by the arrangement of this invention.

In accordance with a modified form of the present invention shown in FIGS. 3 and 4, a further possibility of controlling the dynamics of intake flow is accomplished by providing air flow passageway width control means in the form of a flapper member 24 pivotally mounted within the valve member 18 for directing air flow into the combustion cylinder, the flapper member being movable for selectively occluding a portion of the flow passage area through the valve member for permitting air flow into said cylinder to be governed in part by a varying effective width for the passageway traversed by said inlet flow opening.

The movable wall provided by the flapper member 24 may cooperate with a movable portion of the opposing wall (not shown) of the passageway through the guide means 21, and the injection of fuel may be accomplished through a hollow pivot shaft for the flapper member 24 and orifices formed in the portion of the member adjacent that shaft. Thus there may be variation in the cross sectional area of the fuild flow passageway or variation in the timing of valve opening relative to crankshaft rotation while maintaining constant cross sectional area of the fluid flow passageway.

The diagram of FIG. 4 illustrates some of these possibilities. More particularly, reading FIGS. 3 and 4 together and assuming that the valve member 18 in FIG. 3 rotates clockwise in that figure as indicated by the innermost arrow in FIG. 4, then the vertical axis BDC - TDC may represent the Bottom Dead Center and Top Dead Center positions of the engine crankshaft. The radius designated O in the first quadrant clockwise from BDC may indicate inlet valve opening, and the radius designated C in the first quadrant clockwise from TDC may indicate inlet valve closing. The valve opening dwell shown in 126 degrees before TDC and 72 degrees after for a total of 198 degrees. By use of the movable wall or flapper member, the total dwell may be varied by as much as 30 degrees, as indicated by the dashed line radius between radius C and TDC.

Achievement of a valve opening dwell in excess of 90 degrees of crankshaft rotation has not been possible prior to the present invention, and achievement of a dwell adjustable during engine operation also has not been possible prior to the present invention.

In the drawings and specifications there has been set forth a preferred embodiment of the invention and, although specific terms are used, the description thus given uses terminology in a generic and descriptive sense only and not for purposes of limitation.

What is claimed is:

1. In an internal combustion engine having a cylinder, a piston moving within the cylinder, an intake manifold through which air flows into the cylinder, inlet valve means for controlling the flow of air into the cylinder, and fuel control means for controlling the flow of fuel into the cylinder with the air, an improvement in said inlet valve means and comprising an elongate thin wall right circular cylindrical valve member mounted for rotation within said intake manifold about the longitudinal axis of said valve member and having an arcuate flow opening therethrough extending over an arc of at least about 100 degrees measured on the circumference of a circle described by the intersection of said valve member with a plane perpendicular to said axis, and means for driving said valve member in rotation in timed relation to movement of said piston within said cylinder.

2. Apparatus according to claim 1 further comprising air flow guide means stationarily mounted within the valve member for directing air flow into said cylinder and for establishing the cross sectional area of a flow passageway for such air flow, said guide means occluding no more than a minor portion of the flow passage area through said valve member for permitting air flow into said cylinder to be governed principally by the dwell interval established by the arcuate extent of said inlet flow opening.

3. Apparatus according to one of claim 1 or claim 2 wherein said fuel control means further comprises injection nozzle means mounted within said valve member for directing fuel into said cylinder with air flowing through said valve member.

4. Apparatus according to one of claim 1 or claim 2 further comprising air flow passageway width control means pivotally mounted within said valve member for directing air flow into said cylinder, said control means being movable for selectively occluding a portion of the flow passage area through said valve member for permitting air flow into said cylinder to be governed in part by a varying effective width for the passageway traversed by said inlet flow opening.

5. In an internal combustion engine having a cylinder, a piston moving within the cylinder, an intake manifold through which air flows into the cylinder, inlet valve means for controlling the flow of air into the cylinder, and fuel control means for controlling the flow of fuel into the cylinder with the air, an improvement in said inlet valve means and comprising an elongate thin wall right circular cylindrical valve member mounted for rotation within said intake manifold about the longitudinal axis of said valve member and having an inlet flow opening therethrough extending lengthwise of said member for a predetermined length and arcuately thereabout over an arc of at least about 120 degrees measured on the circumference of a circle described by the intersection of said valve member with a plane perpendicular to said axis, means for driving said valve member in rotation in timed relation to movement of said piston within said cylinder, and air flow guide means stationarily mounted within said valve member for directing air flow into said cylinder and for establishing the cross sectional area of a flow passageway for such air flow, said guide means when viewed in cross section on said plane occluding no more than a minor portion of the cross sectional area of said valve member for permitting air flow into said cylinder to be governed principally by the dwell interval established by the arcuate extent of said inlet flow opening.

6. Apparatus according to claim 5 wherein said valve member is mounted relative to said cylinder with said axis of said member perpendicular to the central axis of said cylinder.

7. Apparatus according to claim 5 wherein said valve member is mounted relative to said cylinder with said axis of said member coplanar with the central axis of said cylinder.

* * * * *